United States Patent [19]

Arakawa

[11] 4,448,222

[45] May 15, 1984

[54] APPARATUS FOR MOUNTING WEFT GUIDING MEMBERS IN JET LOOMS

[75] Inventor: Hiroshi Arakawa, Kariya, Japan

[73] Assignee: Kabushiki Kaisha Toyoda Jidoshokki Seisakusho, Kariya, Japan

[21] Appl. No.: 290,727

[22] Filed: Aug. 7, 1981

[30] Foreign Application Priority Data

Aug. 9, 1980 [JP] Japan ..... 55-109485

[51] Int. Cl.[3] ..... D03D 47/30

[52] U.S. Cl. ..... 139/435; 139/188 R

[58] Field of Search ..... 139/435, 436, 188, 192

[56] References Cited

U.S. PATENT DOCUMENTS 3,461,919 8/1969 Wueger ..... 139/188

FOREIGN PATENT DOCUMENTS 2043717 10/1980 United Kingdom ..... 139/435

*Primary Examiner*—Henry Jaudon

*Attorney, Agent, or Firm*—Brooks, Haidt, Haffner & Delahunty

[57] ABSTRACT

In a jet-operated weaving machine including a race on which are arranged a reed, a series of weft guides forming a weft guiding channel in a shed and a number of auxiliary nozzles provided adjacently along said series of weft guides for injecting therefrom fluid under pressure into said channel thereby to carry all the way of said channel a weft yarn introduced into the shed initially by a jet stream from main nozzle, an apparatus for mounting weft guiding members wherein said weft guides and auxiliary nozzles are mounted integrally on a plural number of mounting blocks which are arranged in a row fixedly on said race, each of said blocks being formed therein fluid passage communicated with said auxiliary nozzles and also connected to fluid supply tube.

7 Claims, 5 Drawing Figures

APPARATUS FOR MOUNTING WEFT GUIDING MEMBERS IN JET LOOMS

BACKGROUND OF THE INVENTION

The present invention relates generally to an apparatus for inserting a weft yarn in jet-operated looms, or more specifically to an apparatus for mounting weft yarn guiding members on a race in said jet-operated looms.

To roughly group the methods of inserting a weft yarn into a shed along the weft picking channel formed by weft guides in jet-operated weaving machines in respect of the injection nozzles in use, there are two types of nozzle arrangements. According to one type, a weft yarn is picked through a shed solely by a fluid jet issued from a main nozzle which is provided at one end of said weft guiding channel; and, according to the other type, a weft yarn is inserted through the channel by jet fluid issued from a plurality of auxiliary nozzles spaced along said channel, as well as from a main nozzle. The latter method, on which the apparatus of the present invention operates, may be further classified into two concrete forms or types in terms of the structure of the weft guide members, as follows:

According to a structure of the first type as represented by U.S. Pat. No. 3,139,118, some of those weft guides which form the channel for picking the weft are formed with a hollow passage therein, respectively, into which fluid under pressure is supplied so that such fluid is injected into said weft guiding channel from a plurality of apertures formed on the peripheries of said hollow guides and in such a way as to surround the channel.

According to the second type as disclosed by U.S. Pat. No. 4,244,402, the weft inserting apparatus thereof comprises a reed which carries the picked weft to the cloth-fell for beat-up, weft guides forming the weft picking channel, and a plurality of auxiliary nozzles spaced along said channel, said auxiliary nozzles being adapted to allow weft carrying medium to be issued therefrom into said channel.

In the former type, in which fluid under pressure is issued from apertures on the peripheries of weft guide members forming part of the guide channel, the fluid thus issued may be controlled immediately after such release by the guide members located on the downstream side, and thus rectified into a flow of imaginary cylindrical shape. However, a drawback of this type is the difficulty and therefore costliness of manufacture.

On the other hand, the second type in which the auxiliary nozzles thereof are located relatively far, as compared with the first type, from the guide channel due to the manner of mounting thereof on the slay, makes it more difficult to properly control the flight of the weft in the guide channel by the fluid from such auxiliary nozzles, but the arrangement is easy to manufacture and is therefore less costly. In the event any weft guides of the latter type must be replaced with new ones due to possible damages thereto, however, the old ones must be removed from the slay independently of the auxiliary nozzles and then new ones must be fixedly mounted on the slay, which means it is difficult to secure accuracy in positioning the new weft guides in relation to the auxiliary nozzles after such replacement. In addition to this drawback, even damage to just part of the guides will call for replacement of all guides as a whole, thus requiring higher cost for maintenance of the weft inserting apparatus.

SUMMARY OF THE INVENTION

The object of the present invention is to eliminate the above-mentioned drawbacks by providing an improved mounting for the weft guiding members.

In construction, the apparatus of the present invention is of a type which comprises a reed which carries a picked weft yarn to the cloth-fell, weft guides which form a weft guiding or picking channel, and auxiliary nozzles spacedly arranged along said channel. In this type of construction, the greatest care must be taken in determining the mounting position of the auxiliary nozzle in relation to that of the weft guides because the position and manner of air injection will greatly influence the condition under which the weft yarn is inserted through the channel. Referring to FIG, 1, the relative positional relationship between weft guide 1 and auxiliary nozzle 2 is shown. As is apparent to those skilled in the art, it is required that an auxiliary nozzle 2 located in front of an open weft guide 1 should be so positioned that a weft yarn may be picked in a stable manner through the weft picking or guiding channel 5 formed by the plurality of said opened guides 1 and closed weft guides 4 by the action of air jets injected from the apertures 3 of said auxiliary nozzles 2. That is, the auxiliary nozzles 2 must perform the function not only of stabilizing the weft in flight in said channel for preventing said weft from escaping through the line of weft slits 6 formed along the guiding channel 5 and also from making a wavy motion in the passage 5 during weft picking, but also to assist in the flight of weft effected initially by main nozzle 7 (FIG. 5). In order to fulfill both of such functions of auxiliary nozzles 2, the relative locations between the weft guides 1, 4 and auxiliary nozzles 2 are carefully selected or determined through a number of repeated reseaches and experiments. Because the weft guides 1, 4 are required to form and maintain an extremely uniform guide channel 5, the guides are usually installed securely in the groove 9 of mounting block 8 with use of adhesive 10 (FIG. 4) made of resin or the like.

The weft guides 1, 4 may have to be replaced with new ones for various reasons such as development of wear after a prolonged period of service due to concentrated contacting between the weft yarn in flight and part of any of the weft guides 1, 4 or unexpected damage thereto.

In replacing old guides with new ones, two problems are often encountered. Firstly, since the weft guides are fixed to the mounting block by use of adhesive, replacement of even some of the guides will make it necessary to change all of them along the entire picking width, thus presenting economical disadvantage. The second problem associated with such replacement is the possible change in the mounting position of the weft guides relative to the auxiliary nozzles. Since separate mounting blocks have been heretofore used for mounting the guides and auxiliary nozzles, respectively, the relative positional relationship therebetween would be changed as a matter of course if the guide mounting position is affected by the condition under which the mounting blocks are clamped onto the race, or other possible factors.

Therefore, the apparatus of the present invention, which is based on the idea that the auxiliary nozzles must be located as close to the weft guides as possible for fulfillment of inherent functions of the former to stabilize and to assist in the flight of weft yarn in the shed, provides an improvement in mounting of weft guiding members with a view to eliminating the above-mentioned disadvantages associated with replacement of guides, i.e., the economical problem arising from the necessity of replacing all guides and unavoidable change in the relative positional relation between the auxiliary nozzles and guides in mounting the latter. This is accomplished by installing weft guides and auxiliary nozzles securely on mounting blocks which are connected to each other in a line and fixed on a race, forming in each of said blocks a passage communicating with said nozzles, and further connecting a fluid supply tube to said passage.

BRIEF DESCRIPTION OF THE DRAWINGS

The accompanying drawings illustrating an embodiment of the present invention include the following.

DETAILED DESCRIPTION OF THE PREFERRED EMBODIMENT

Figure 4:
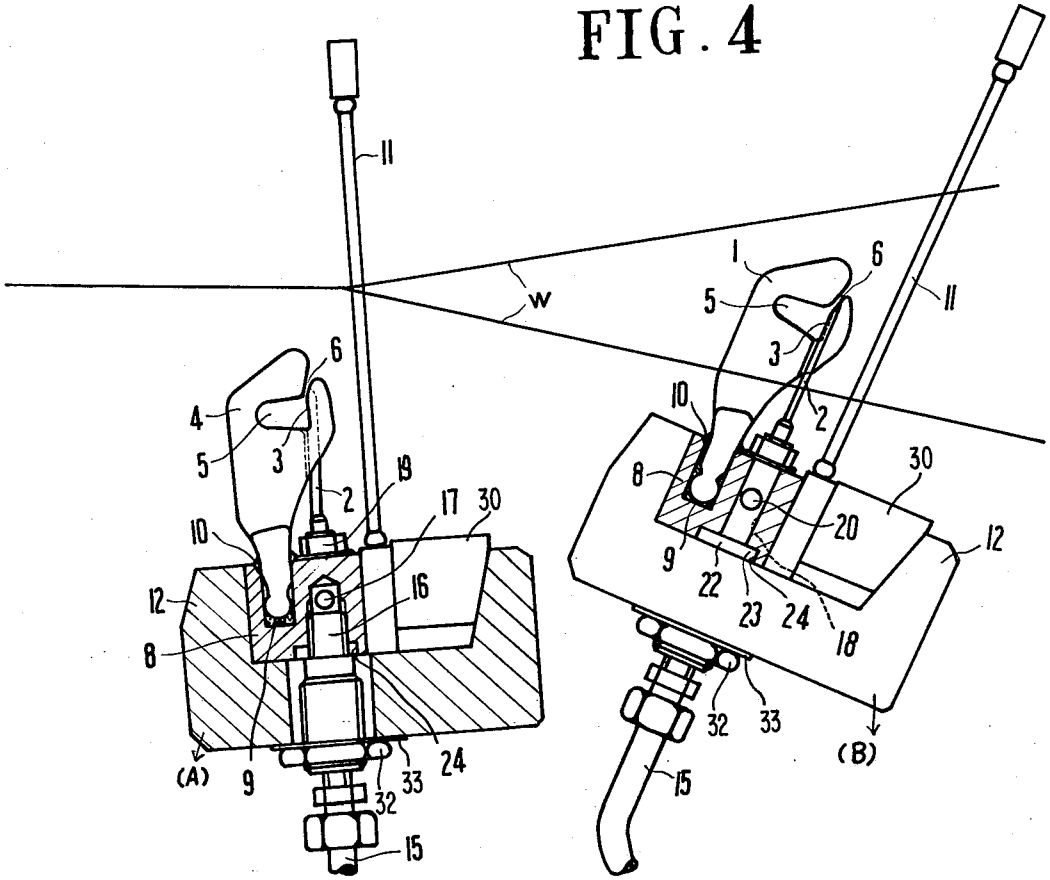
FIG. 4 is a side sectional view showing the swinging movement of the race and also the manner in which weft guiding members are installed on the race.

Referring to FIG. 4, the weaving process associated with weft yarn in a jet-operated loom is carried out while the race 12 is swung reciprocally between the positions designated by A and B. In position B, picking of a weft yarn into a shed along the weft guiding channel 5 formed in said shed by the weft guides 1, 4 is accomplished by the action of fluid or air under pressure injected from the main nozzle 7 (FIG. 5) and auxiliary nozzles 2. While the race 12 is moved back to position A, the weft thus picked is held by and between the upper and lower sheets of warp yarns W after being slipped out of the channel 5 through weft slit 6, and then carried by the reed 11 up to the cloth-fell, thus completing a beat-up of weft yarn.

Figure 5:
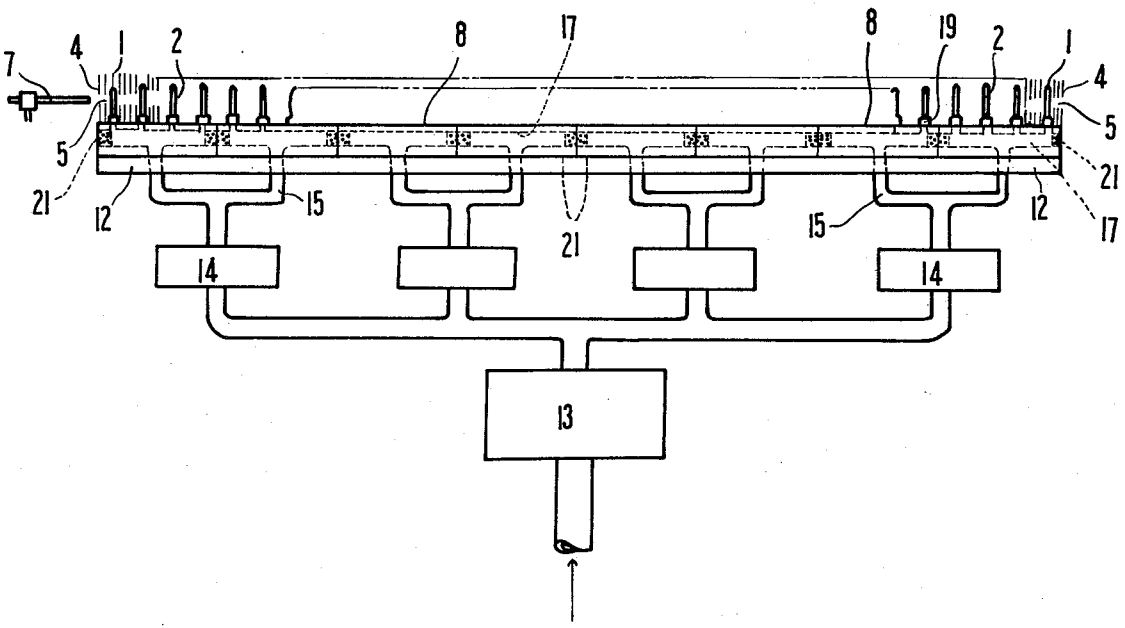
FIG. 5 is a schematic diagram showing the piping system for fluid under pressure to be supplied to auxiliary nozzles.

According to an embodiment of the present invention, on the race 12 are mounted auxiliary nozzles 2 on the reed side and weft guides 1, 4 on the cloth-fell side, respectively, as shown in FIG. 4. In order that successful picking of the weft is ensured, the auxiliary nozzles 2 which play a key role in weft handling in jet-operated looms in collaboration with the weft guides 1, 4 should desirably be provided integrally therewith. For this purpose, the guides 1, 4 and auxiliary nozzles 2 are mounted on a series of mounting blocks 8 which are arranged in a row along the weaving width, as shown in FIG. 5. The blocks 8 are mounted on the race 12 by wedge blocks 30 as shown in FIG. 4, as is a conventional manner of mounting. According to prior art, weft guides and auxiliary nozzles have been mounted on respective separate blocks with a third member intervening therebetween, whereby it has been made practically difficult to provide auxiliary nozzles close enough to the weft filling channel formed by the weft guides for the weft yarns in flight to be controlled properly in said channel. By contrast, the present invention can provide a novel structure by which the injection apertures 3 of auxiliary nozzles 2 may be located close enough to the weft guiding channel 5 for proper control of the flight of weft yarns. In addition, because the weft guides 1, 4 and auxiliary nozzles 2 are mounted at their optimum positions relative to each other on the blocks 8, and said blocks 8 which serve as a mounting base therefor are constructed into substantially a solid and integral base member, the position of the auxiliary nozzles will remain unchanged in relation to that of weft guides 1, 4 even if the former nozzles are replaced with new ones due to clogging of air injection apertures 3 of any of the nozzles 2. Also in the event that guides 1, 4 are replaced because of development of excessive wear or any other damages thereto, they can be removed for renewal together with the auxiliary nozzles 2 (in such a case, thus removed nozzles 2 may be reused as a matter of course). Thus the relative mounting positions between the weft guides 1, 4 and auxiliary nozzles 2 remain unaffected even after replacement thereof.

The present invention is designed, in view of the fact that wear will not take place in all of weft guides 1, 4 in a uniform manner but will develop relatively remarkably only in some of such guides, to provide sectional mounting blocks 8 so that the economical problem arising from guide replacing may be solved. As to the number of such mounting block sections which are arranged in abutting end-to-end relation in a row extending the entire weaving width, any desired number may be selected. In this way, merely by removing from the race 12 only those individual blocks 8 which carry thereon guides 1, 4 calling for renewal, replacement of new blocks 8 can be accomplished economically without influencing the other blocks 8.

Figure 1:
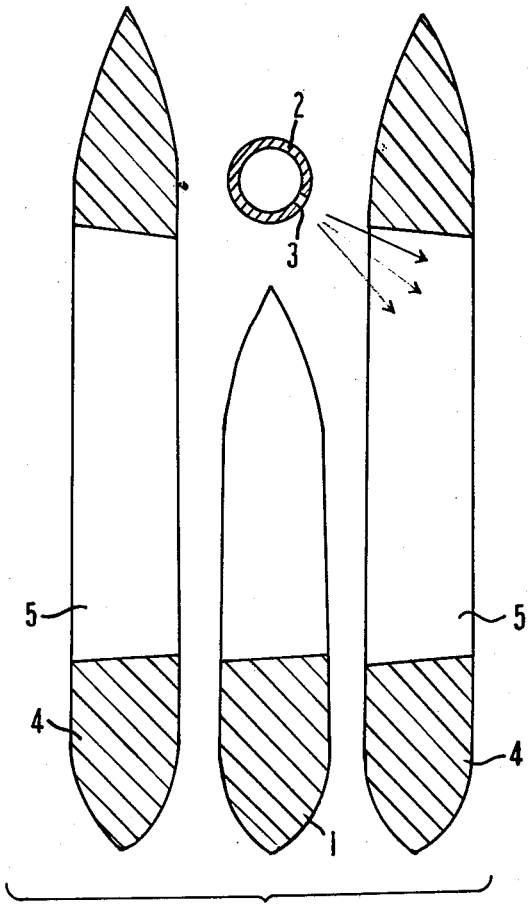
FIG. 1 is a plan sectional view showing the relative positional relationship between weft guides and an auxiliary nozzle.
Figure 2:
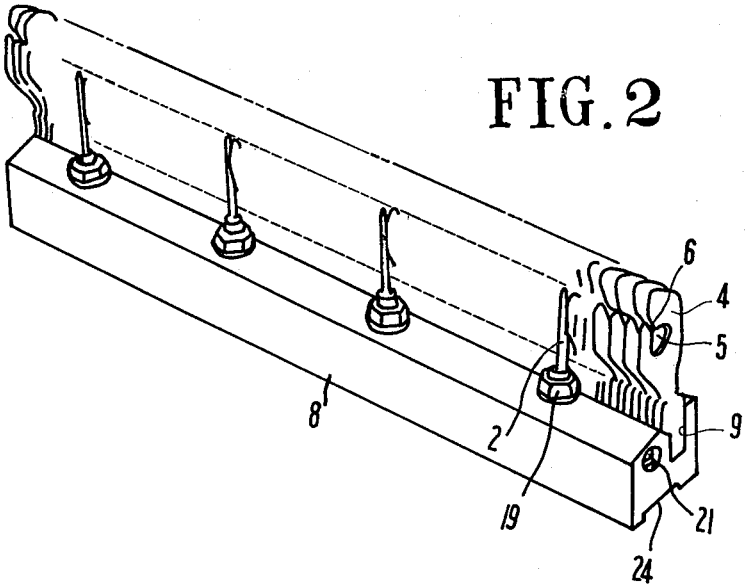
FIG. 2 is a perspective view showing the block on which weft guides and auxiliary nozzles are mounted according to the present invention.
Figure 3:
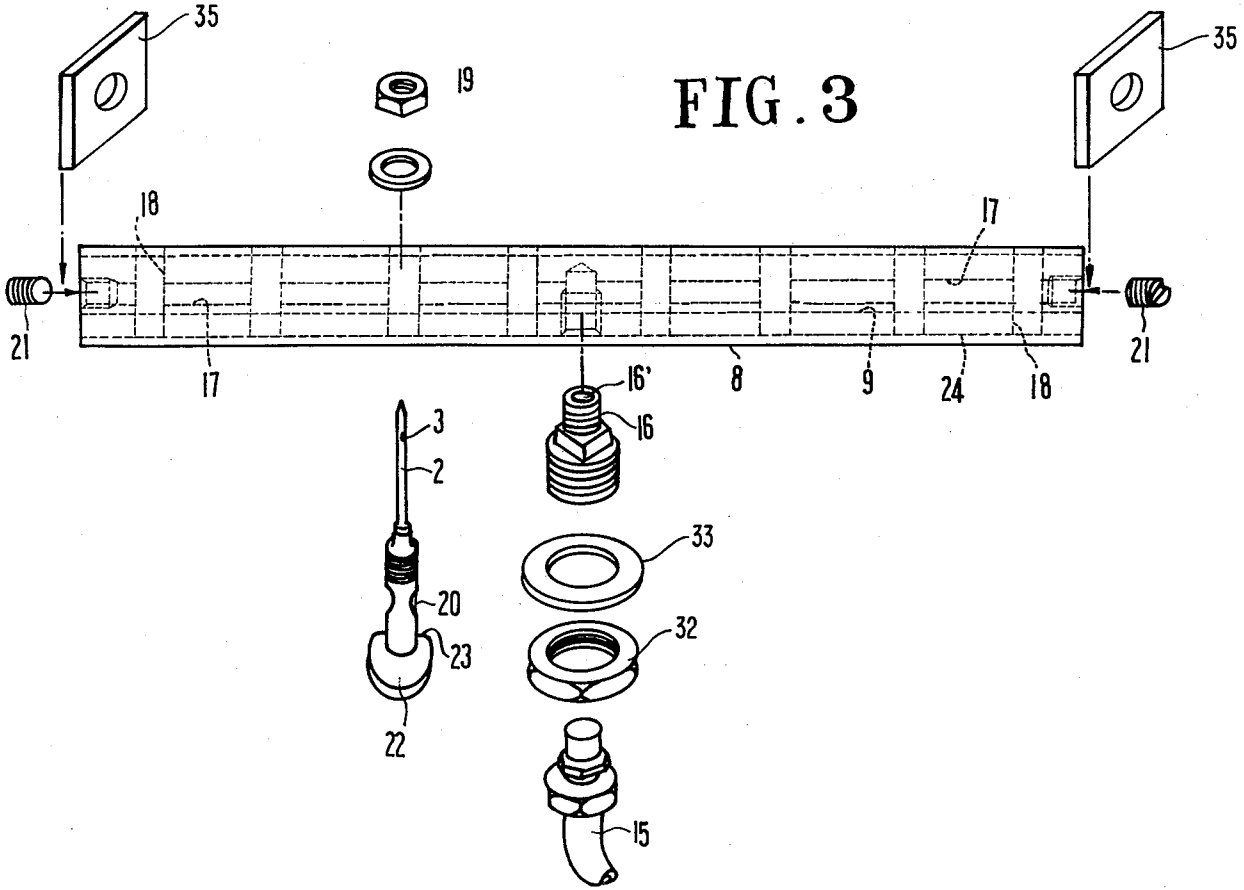
FIG. 3 is an exploded view of the block of FIG. 2.

In the illustrated embodiment of the present invention, the fluid under pressure for auxiliary nozzles mounted on blocks 8 is supplied to each of such blocks independently. Namely, as detailed in FIG. 5, such fluid is supplied from any appropriate source, such as air tank 13, which is connected to a plurality of pressure adjusting valves 14 which are connected in turn to air supply tubes 15 for the respective mounting blocks 8. As shown in FIG. 3 and FIG. 5, the supply tubes 15 are connected to each of mounting blocks 8 via connecting joints 16 whose opening 16' is, when fitted properly, communicated with air passage 17 formed in said block 8, and the fluid under pressure filling said air passage 17 is blown into each of the auxiliary nozzles 2, which are fitted in spaced mounting holes 18 in block 8 by means of fastening nuts 19, through the inlet ports 20 formed in said nozzle 2. To secure air-tightness of said passage 17 in each block, the ends on both sides of the passage 17 are blocked by sealing screws 21 screwed in both ends of the block 8. When removing any mounting blocks 8 for replacement, such blocks are just released from the connections with the race 12 by releasing the wedge block 30 and also with the fluid supply tubes 15. A wedge block 30 extends across the race 12 so that all of the series of mounting blocks 8 will be loosened upon prying the wedge block 30 upwardly to loosen it, as will be understood by reference to FIG. 4. The fluid supply tube 15 to any particular mounting block is disconnected by removing the threaded nut 32 and flat washer 33, which releases the tube from the fitting 16, as indicated in FIGS. 3 and 4. Thus, any individual block 8 may be removed. To permit accurate alignment of auxiliary nozzles 2 in mounting thereof on the block 8, each of the nozzles 2 is provided with a base member 22 which is adapted to be engaged with the locating groove 24 at the bottom of block 8 so that the auxiliary nozzles 2 may be located relative to the weft guides 1, 4 at a predetermined height and also at a proper angular position, which is obtained by the locating portion 23 formed in said base member 22.

As it is apparent from the foregoing description, the mounting blocks 8 according to the present invention can make it possible to maintain the correct relative positional relationship between the weft guides 1, 4 and auxiliary nozzles 2 at all times, and also offers an advantage from an economical aspect in that wear in some of the guides 1, 4 will not call for replacing all of them. In addition, the construction of the weft picking apparatus of the present invention may be much simplified over the prior art because the air passage in communication with each of the auxiliary nozzles 2 is formed within the mounting block 8.

The apparatus of the present invention may be modified into any form of the embodiments that follow:

Arrangement on the race 12 may be such that the weft guides 1, 4 are provided on the reed side and the auxiliary nozzles 2 on the cloth-fell side.

The weft guide 1, 4 does not have to be located in opposite relation to the auxiliary nozzle. That is, the auxiliary nozzle 2 may be positioned between any two adjacent guides and on the side where the weft slit 6 is formed therein.

As to the weft guides themselves, two different forms 1 and 4 as shown in the drawings do not have to be used; all guides may be of an identical form.

Furthermore, a single fluid supply tube may be connected to all or any desired number of mounting blocks 8, not in the illustrated manner in which a single tube is assigned to each single block. It is preferred in such a modified embodiment that any suitable member made of rubber or the like with adequate air-tightness for allowing communication between the fluid passages 17 in two adjacent mounting blocks 8, but not allowing any escape of fluid through the joints between two such blocks, should be installed at such joints. Such a rubber member 35 is illustrated as an alternative embodiment in FIG. 3. One of the members 35 is shown ready for positioning at each end of a mounting block 8 to be disposed between the block and its respectively adjacent mounting blocks at each end (not shown), to seal each interface against the escape of air when the blocks are mounted in end-to-end relation along the race 12.

What is claimed is:

1. In a jet-operated weaving machine including a main nozzle, a race on which are arranged a reed, a series of weft guides forming a weft guiding channel in a shed and a number of auxiliary nozzles provided adjacently along said series of weft guides for injecting therefrom fluid under pressure into said channel thereby to carry through said channel a weft yarn introduced into the shed by a jet stream from said main nozzle, apparatus for mounting said weft guides and said auxiliary nozzles, comprising a plurality of mounting blocks, a plurality of said weft guides and at least one of said auxiliary nozzles being mounted integrally on each of said mounting blocks, all of said series of weft guides and said number of auxiliary nozzles being mounted on said mounting blocks, said mounting blocks being arranged end-to-end in a row in substantially abutting relation and fixedly but individually removably mounted on and along said race, releasable means mounting said blocks on said race, each of said mounting blocks having formed therein a fluid passage communicating with each of said auxiliary nozzles thereon, fluid supply means, and means connecting said fluid passages to said fluid supply means.

2. Apparatus according to claim 1, wherein said fluid passages in said row of said mounting blocks are aligned with, and are in fluid flow communication with each other.

3. Apparatus according to claim 1, wherein each said mounting block has an underside surface and an upperside surface, and each of said auxiliary nozzles comprises a nozzle tube extending through said mounting block from said underside surface thereof and projecting from said upperside surface thereof, each said nozzle tube having means defining a locating portion thereof, each said mounting block having means defining a locating portion thereof for receiving said nozzle tube locating portion of each said nozzle tube mounted on said mounting block, whereby the angular and height positions of each of said auxiliary nozzles are accurately determined.

4. Apparatus according to claim 3 wherein said means defining said locating portion of each said nozzle tube comprises a laterally projecting base portion thereon, and each of said means defining the respective of said mounting block locating portions comprises means defining a recessed portion of said mounting block underside surface, said nozzle tube base portions and said mounting block recessed portions having comating shapes.

5. Apparatus according to claim 1, which comprises a plurality of said auxiliary nozzles mounted on each of said mounting blocks in spaced apart relation, and substantially equal pluralities of said weft guides mounted between each of said auxiliary nozzles of each of said mounting blocks, and said fluid supply means comprises a fluid supply tube connected to each of said mounting blocks, respectively, and in fluid communication with said fluid passage thereof.

6. A mounting block for mounting weft guides and auxiliary nozzles on a race of a weaving machine, said mounting block comprising a plurality of weft guides mounted on said mounting block and forming a weft guiding channel therealong, a plurality of auxiliary nozzles mounted on said mounting block in spaced apart relation therealong, each of said auxiliary nozzles comprising a nozzle tube extending through said mounting block and having a locating portion thereon, said mounting block having a locating portion thereof for receiving each of said auxiliary nozzle locating portions, respectively, whereby the angular and height position of each of said auxiliary nozzles on said mounting block are accurately determined, means defining a fluid passage communicating with all of said auxiliary nozzles, and means for connecting a fluid supply pipe to said mounting block in fluid communication with said fluid passage.

7. Apparatus according to claim 6 wherein said nozzle tube locating portion of each said nozzle tube comprises a laterally projecting base member on the nozzle tube, and each said mounting block locating portion comprises recessed surface means of the mounting block for receiving said nozzle tube base member, each of said nozzle tube base members and the respective of said mounting block recessed surface means being correspondingly shaped for comating engagement.

* * * * *